US008760272B2

(12) United States Patent
Lien et al.

(10) Patent No.: US 8,760,272 B2
(45) Date of Patent: Jun. 24, 2014

(54) ELECTRIC WHISTLE

(76) Inventors: Yen-Hsiang Lien, New Taipei (TW); Ting Yang, New Taipei (TW)

( * ) Notice: Subject to any disclaimer, the term of this patent is extended or adjusted under 35 U.S.C. 154(b) by 223 days.

(21) Appl. No.: 13/551,759

(22) Filed: Jul. 18, 2012

(65) Prior Publication Data

US 2014/0022063 A1 Jan. 23, 2014

(51) Int. Cl.
*G08B 3/10* (2006.01)

(52) U.S. Cl.
USPC ..... 340/384.73; 340/384.1; 340/384.7; 340/393.2; 340/384.4; 340/388.1

(58) Field of Classification Search
USPC ..... 340/384.73, 384.1, 384.7, 393.2, 384.4, 340/388.1
See application file for complete search history.

(56) References Cited

U.S. PATENT DOCUMENTS 4,829,570 A * 5/1989 Schotz ..... 381/3
4,908,604 A * 3/1990 Jacob ..... 340/539.16
4,941,388 A * 7/1990 Hoover et al. ..... 84/726

FOREIGN PATENT DOCUMENTS

TW M245574 10/2004

* cited by examiner

*Primary Examiner* — George Bugg
*Assistant Examiner* — Naomi Small
(74) *Attorney, Agent, or Firm* — Maier & Maier, PLLC

(57) ABSTRACT

An electric whistle has a power circuit, an inductor, an electric switch, a buzzer, a tone-set resistor and a sound IC. The sound IC generates an audio control signal to activate the electric switch. When the electric switch is activated, the inductor produces an induction voltage to activate the buzzer. The oscillation frequency of the audio control signal is determined by the single tone-set resistor without a capacitor. Therefore, few passive devices are used. The electric whistle of the present invention is compact and portable.

13 Claims, 3 Drawing Sheets

ELECTRIC WHISTLE

BACKGROUND OF THE INVENTION

1. Field of the Invention

The present invention relates to an electric whistle, and more particularly to an electric whistle with a small bulk which is compact and is convenient to be carried by a user.

2. Description of Related Art

A whistle is used for many purposes, such that:

A police officer can shrilly attract the attention of the public, especially over background noise such as traffic, and in a much louder manner than merely shouting.

At a ball game, an umpire can blow the whistle to inform the players about the judgments, such as rule breaking.

When a person is, suffering an attack on a street, the person can blow the whistle loudly to deter the attacker, and attract the attention of people nearby to ask for help.

With reference to Taiwan patent No. M245574, an electric whistle is disclosed. The electric whistle is more sanitary than a conventional whistle which is put into the mouth because the electric whistle can buzz loudly without being blown.

With reference to FIG. 3, the electric whistle comprises a control integrated circuit (IC) 40, multiple resistors R1-R3, a capacitor C1, an inductor L, a transistor Q1 and a buzzer 50.

The control IC 40 includes a first pin, a fourth pin, a fifth pin and a seventh pin. The seventh pin is adapted to electrically connect to a power source VCC to receive a working voltage.

The resistor R3 is electrically connected between the fourth pin and the seventh pin.

The capacitor C1 is electrically connected to the seventh pin.

The resistor R2 is electrically connected to the capacitor C1 in parallel.

The inductor L has a first coil La and a second coil Lb. The first coil La is electrically connected to the power source. The second coil Lb is coupled to the first coil La.

The transistor Q1 is a bipolar junction transistor (BJT), such as an NPN-typed BJT. The transistor Q1 has a base, a collector and an emitter. The base is electrically connected to the first pin of the control IC 40. The collector is electrically connected to the first coil La and the second coil Lb. The emitter is grounded.

The resistor R1 is electrically connected between the base and the emitter of the transistor Q1.

The buzzer 50 is electrically connected to the second coil Lb of the inductor L.

The control IC 40 generates an oscillation signal and sends the oscillation signal to the transistor Q1 via the first pin to activate the transistor Q1. The oscillation frequency of the oscillation signal is determined by the capacitor C1 and the resistors R2, R3.

When the transistor Q1 is turned ON, a current flows through the first coil La and the first coil La induces a magnetic field. Then the second coil Lb senses the magnetic field to produce an induction voltage to activate the buzzer 50.

However, passive devices, such as the capacitor C1 and the resistors R2 which are necessary for determining the oscillation frequency of the oscillation signal, certainly increase the bulk of the conventional electric whistle. The use of those passive devices means that the bulk of the conventional electric whistle cannot be reduced, thus rendering the electric whistle inconvenient being taken around by the user. Furthermore, the multiple passive devices will cause an excessively high manufacturing cost.

SUMMARY OF THE INVENTION

An objective of the present invention is to provide an electric whistle that has few passive devices to reduce the bulk of the whistle and can be manufactured at low cost.

The electric whistle of the present invention comprises a power circuit, an inductor, an electric switch, a buzzer, a tone-set resistor and a sound IC.

The power circuit generates a working voltage.

The inductor has a first pin, a common pin, a second pin, a first coil and a second coil. The first pin is connected to the power circuit. The first coil is connected between the first pin and the common pin. The second coil is connected between the second pin and the common pin and coupled to the first coil.

The electric switch is connected between the common pin and a ground and has a control terminal.

The buzzer is connected between the second pin and the common pin of the inductor.

The tone-set resistor has two terminals.

The sound IC has a power pin, two oscillation frequency set pins, a database, multiple selection pins, an audio output pin and an oscillation unit.

The power pin is connected to the power circuit to receive the working voltage.

The two oscillation frequency set pins are respectively connected to the two terminals of the tone-set resistor.

The database stores multiple sound tracks.

The selection pins respectively correspond to the sound tracks. One of the multiple selection pins is selected to choose a corresponding sound track.

The audio output pin is connected to the control terminal of the electric switch.

The oscillation unit which is connected to the oscillation frequency set pins, the power pin, the audio output pin, the database and the selection pins, generates an audio control signal based on the selection pin which is grounded and sends the audio control signal to the electric switch via the audio output pin. An oscillation frequency of the audio control signal is determined by the tone-set resistor.

With respect to the electric whistle of the present invention, the sound IC has sound tracks installed as original equipment. The oscillation frequency of the audio control signal is completely determined by the single tone-set resistor without a capacitor. Compared with the conventional electric whistle, the electric whistle of the present invention has fewer passive devices. Therefore, the electric whistle of the present invention is compact and can be manufactured at low cost.

DETAILED DESCRIPTION OF THE PREFERRED EMBODIMENT

Figure 1:
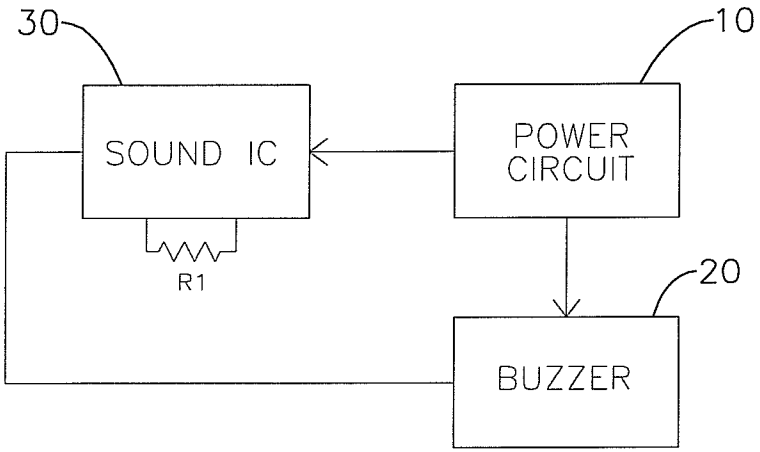
FIG. 1 is a block diagram of an embodiment of the present invention.
Figure 2:
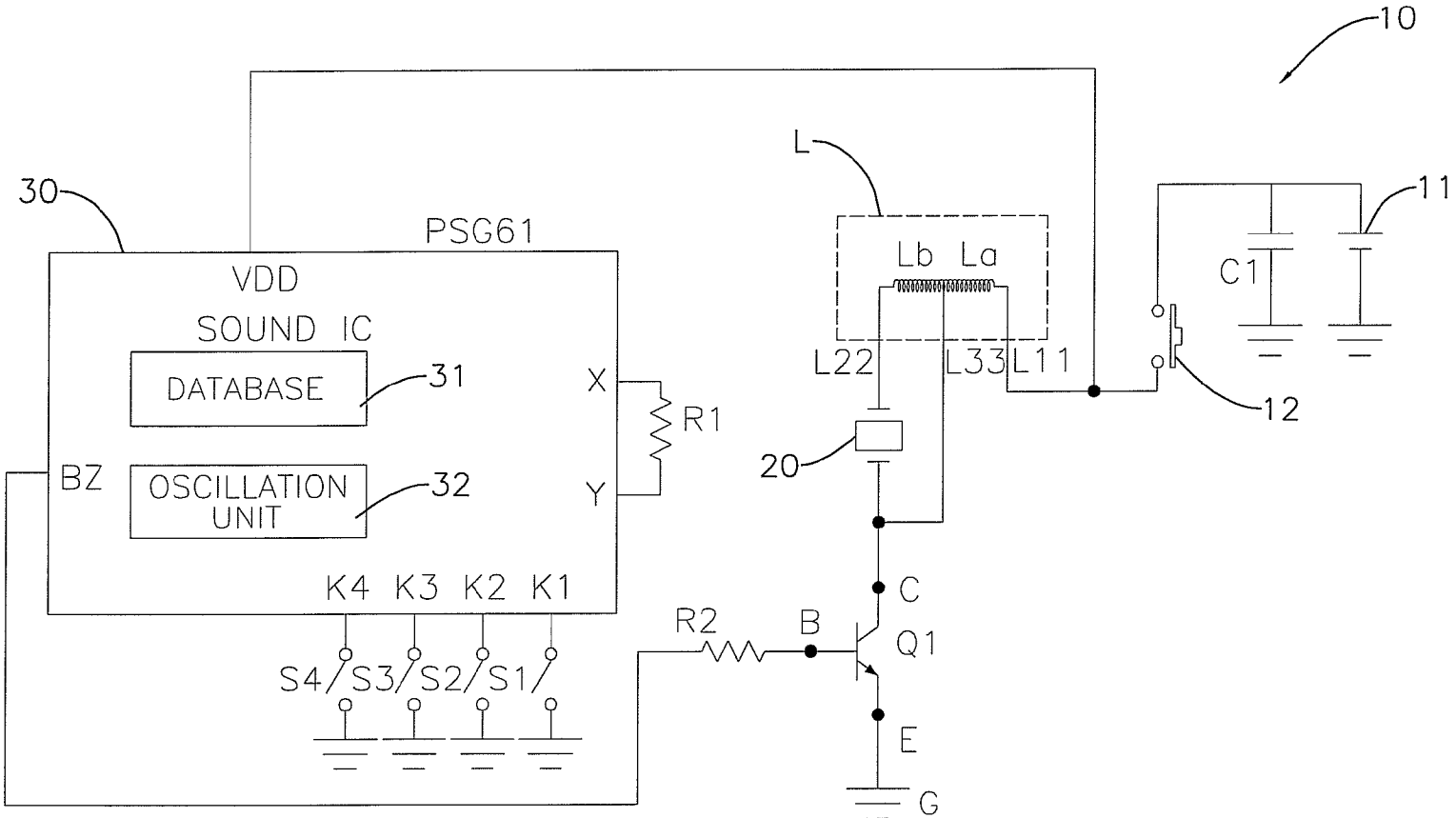
FIG. 2 is a detailed circuit diagram of the embodiment of the present invention.
Figure 3:
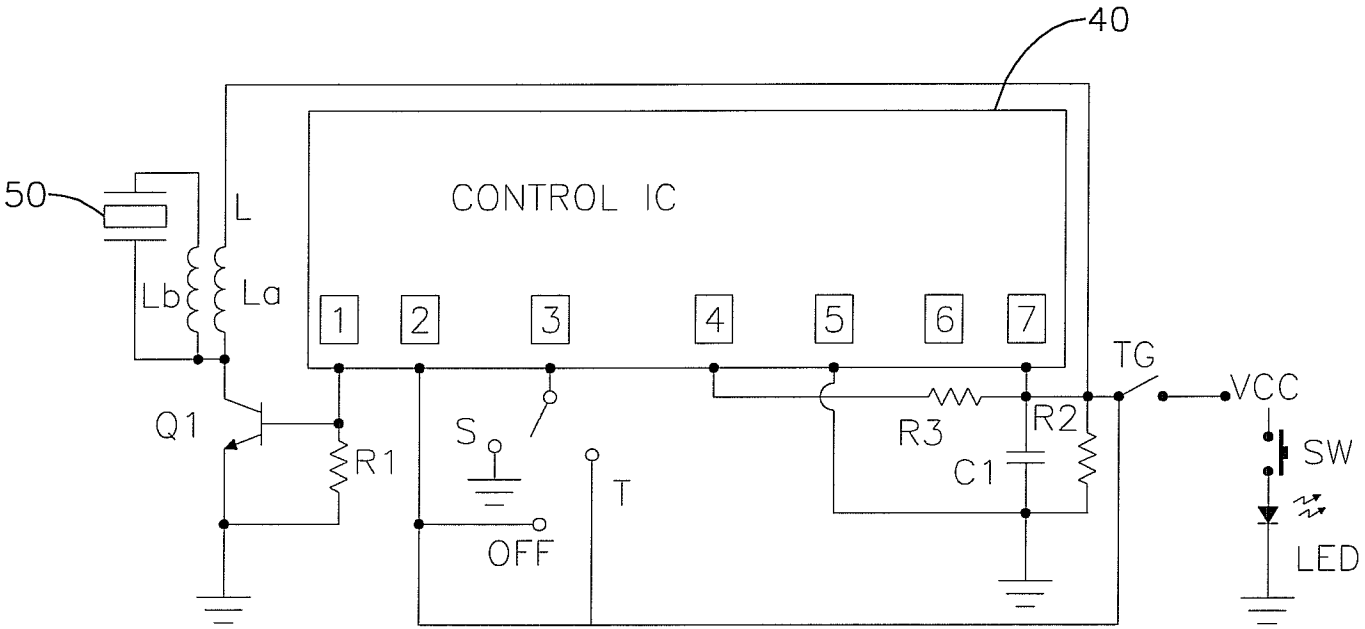
FIG. 3 PRIOR ART
FIG. 3 is a circuit diagram of a conventional electric whistle.

With reference to FIGS. 1 and 2, a first embodiment of the present invention comprises a power circuit 10, an inductor L, an electric switch Q1, a buzzer 20, a tone-set resistor R1 and a sound IC 30.

The power circuit 10 has a mobile power pack 11, a power switch 12 and a capacitor C1. The mobile power pack 11 generates a working voltage. In this embodiment, the mobile power pack 11 is a battery. The power switch 12 is a normally open switch and is electrically connected to the mobile power pack 11 in series. The capacitor C1 is electrically connected to the mobile power pack 11 in parallel. The capacitor C1 is adapted to filter unstable noises to gain the stability of the electric whistle of the present invention. When the power switch 12 is turned ON, the working voltage can be sent out.

The inductor L has a first coil La, a second coil Lb, a first pin L11, a second pin L22 and a common pin L33. The first pin L11 is electrically connected to the mobile power pack 11. The first coil La is electrically connected between the first pin L11 and the common pin L33. The second coil Lb is electrically connected between the second pin L22 and the common pin L33 and is coupled to the first coil La.

The electric switch Q1 is electrically connected between the common pin L33 and a ground G and has a control terminal. In this embodiment, the electric switch Q1 is a BJT (bipolar junction transistor) of NPN-type. The BJT has a base B, an emitter E and a collector C. The base B is regarded as the control terminal. The collector C is electrically connected to the common pin L33. The emitter E is grounded.

The buzzer 20 is electrically connected between the second pin L22 and the common pin L33 of the inductor L. The buzzer 20 is a piezoelectric device. The sound level of the buzzer 20 is directly proportional to the voltage across the second pin L22 and the common pin L33.

The tone-set resistor R1 has two terminals. In this embodiment, the tone-set resistor R1 is 100 k ohms (Ω).

The sound IC 30 has a power pin VDD, two oscillation frequency set pins (X)(Y), multiple selection pins K1-K4, an audio output pin BZ, a database 31 and an oscillation unit 32. In this embodiment, the type of the sound IC 30 is PSG61.

The power pin VDD is electrically connected to the mobile power pack 11 through the power switch 12 to receive the working voltage.

The two oscillation frequency set pins (X)(Y) are respectively and electrically connected to the two terminals of the tone-set resistor R1.

The database 31 stores different sound tracks, such as long beeps, short beeps and whistle ringing.

The selection pins K1-K4 respectively correspond to the sound tracks and respectively connect to switches S1-S4. The switches S1-S4 are normally open switches and are used to ground the selection pins K1-K4. For example, the selection pin K1 corresponds to the long beeps, the selection pin K2 corresponds to the short beeps and the selection pin K4 corresponds to the whistle ringing. A user can choose one sound track of interest by pressing the switch S1-S4 to connect a corresponding selection pin K1-K4 to the ground G.

The audio output pin BZ is electrically connected to the control terminal of the electric switch Q1, wherein a bias resistor R2 can be electrically connected between the audio output pin BZ and the control terminal.

The oscillation unit 32 is electrically connected to the power pin VDD, the oscillation frequency set pins (X)(Y), the selection pins K1-K4, the audio output pin BZ and the database 31. The oscillation unit 32 determines which one of the selection pins K1-K4 is grounded and generates an audio control signal based on the tone-set resistor R1 and the corresponding sound track. For example, when the selection pin K4 is grounded, the oscillation unit 32 generates the audio control signal of the whistle ringing. The tone-set resistor R1 is used to determine the oscillation frequency of the audio control signal to time the tone of the whistle ringing.

The audio control signal comprises multiple high potentials and multiple low potentials changed alternately. When the electric switch Q1 receives the audio control signal, the electric switch Q1 is turned ON at the high potentials and is turned OFF at the low potentials. When the electric switch Q1 is turned ON, the mobile power pack 11, the first coil La of the inductor L and the electric switch Q1 form a current loop and a current flows through the first coil La. When the current flows through the first coil La, the first coil La induces a magnetic field. Then the second coil Lb senses the magnetic field and generates an induction voltage to activate the buzzer 20.

According to the selected audio control signal sent from the audio output pin BZ, the electric switch Q1 is turned ON and OFF alternatively. The first coil La is then activated to induce the second coil Lb for producing the induction voltage corresponding to the audio control signal. Therefore, the buzzer 20 is activated by the induction voltage and buzzes as the emitted sound.

The buzzer 20 is basically controlled by the audio control signal. In comparison to the conventional electric whistle, the oscillation frequency of the audio control signal in accordance with the present invention is simply determined by the tone-set resistor R1 without a capacitor. Because there are fewer passive devices used, the electric whistle of the present invention is compact and the manufacturing cost is relatively low.

What is claimed is:

1. An electric whistle comprising:

a power circuit generating a working voltage;

an inductor having:

a first pin connected to the power circuit;

a common pin;

a second pin;

a first coil connected between the first pin and the common pin; and a second coil connected between the second pin and the common pin and coupled to the first coil;

an electric switch connected between the common pin and a ground and having a control terminal;

a buzzer connected between the second pin and the common pin of the inductor;

a tone-set resistor having two terminals; and a sound IC having:

a power pin connected to the power circuit to receive the working voltage;

two oscillation frequency set pins respectively connected to the two terminals of the tone-set resistor;

a database storing multiple sound tracks;

multiple selection pins respectively corresponding to the sound tracks, wherein one of the multiple selection pins is selected to choose a corresponding sound track;

an audio output pin connected to the control terminal of the electric switch; and an oscillation unit connected to the oscillation frequency set pins, the power pin, the audio output pin, the database and the selection pins, generating an audio control signal based on the selection pin which is grounded and sending the audio control signal to the electric switch via the audio output pin, wherein an oscillation frequency of the audio control signal is determined by the tone-set resistor.

2. The electric whistle as claimed in claim 1, the power circuit having:

a mobile power pack generating the working voltage; and a power switch electrically connected to the mobile power pack in series.

3. The electric whistle as claimed in claim 2, wherein the power circuit further comprises a capacitor electrically connected to the mobile power pack in parallel.

4. The electric whistle as claimed in claim 1 further comprising a bias resistor connected between the audio output pin and the control terminal.

5. The electric whistle as claimed in claim 2 further comprising a bias resistor connected between the audio output pin and the control terminal.

6. The electric whistle as claimed in claim 3 further comprising a bias resistor connected between the audio output pin and the control terminal.

7. The electric whistle as claimed in claim 1, wherein the electric switch is a BJT of NPN-type and has:

a base regarded as the control terminal;

a collector connected to the common pin; and an emitter being grounded.

8. The electric whistle as claimed in claim 2, wherein the electric switch is a BJT of NPN-type and has:

a base regarded as the control terminal;

a collector connected to the common pin; and an emitter being grounded.

9. The electric whistle as claimed in claim 3, wherein the electric switch is a BJT of NPN-type and has:

a base regarded as the control terminal;

a collector connected to the common pin; and an emitter being grounded.

10. The electric whistle as claimed in claim 4, wherein the electric switch is a BJT of NPN-type and has:

a base regarded as the control terminal;

a collector connected to the common pin; and an emitter being grounded.

11. The electric whistle as claimed in claim 5, wherein the electric switch is a BJT of NPN-type and has:

a base regarded as the control terminal;

a collector connected to the common pin; and an emitter being grounded.

12. The electric whistle as claimed in claim 6, wherein the electric switch is a BJT of NPN-type and has:

a base regarded as the control terminal;

a collector connected to the common pin; and an emitter being grounded.

13. The electric whistle as claimed in claim 1, wherein the sound IC is PSG61.

* * * * *